United States Patent [19]

Gregory, Jr.

[11] Patent Number: 4,546,868

[45] Date of Patent: Oct. 15, 1985

[54] COIN TESTING APPARATUS

[75] Inventor: Lester Gregory, Jr., Rockford, Ill.

[73] Assignee: Patent Research Development Corporation, Rockford, Ill.

[21] Appl. No.: 478,842

[22] Filed: Mar. 25, 1983

[51] Int. Cl.[4] ..... G07F 3/02

[52] U.S. Cl. ..... 194/97 A; 194/97 R

[58] Field of Search ..... 194/97 R, 97 A

[56] References Cited

U.S. PATENT DOCUMENTS

| | | | |
|---|---|---|---|
| 3,978,962 | 9/1976 | Gregory | 194/97 A |
| 3,998,309 | 12/1976 | Mandas et al. | 194/97 R |
| 4,089,400 | 5/1978 | Gregory | 194/97 A |
| 4,128,157 | 12/1978 | Henville | 194/97 R |
| 4,257,435 | 3/1981 | Tanaka et al. | 194/97 R X |

*Primary Examiner*—F. J. Bartuska

*Attorney, Agent, or Firm*—Dennis H. Lambert

[57] ABSTRACT

A coin testing apparatus for discriminating between acceptable and unacceptable coins has a ramp down which coins are constrained to roll. A first optical device is positioned in predetermined spaced relationship with the ramp to detect a first parameter of a coin rolling down the ramp to produce a first signal of predetermined timed duration for a coin having the proper first parameter. A second optical device is spaced in predetermined relationship with the first optical device to detect a second parameter of the coin and produce an output signal for a coin having the proper first and second parameters. The output signal energizes a device for detaining coins having an improper third parameter until expiration of the timed duration of the first signal, and a reject mechanism is operatively connected to reject any coins having an improper parameter. A third optical device is positioned in the path of coins leaving the ramp and is connected with a reset to disable the apparatus for a predetermined duration of time when an attempt is made to withdraw a coin back through the apparatus in a reverse direction past the third optical device, and a coin detecting device is positioned in the path of a coin passing all of the tests to produce a "vend" signal.

3 Claims, 8 Drawing Figures

COIN TESTING APPARATUS

BACKGROUND OF THE INVENTION

1. Field of the Invention

This invention relates to apparatus for discriminating between acceptable and unacceptable coins. More particularly, the invention is used to test coins fed to vending machines of various types, such as coin-operated laundries, electronic games and dispensing machines for food and the like. The invention represents an improvement over earlier U.S. Pat. Nos. 3,978,962 and 4,089,400.

2. Prior Art

The use of coin-operated and controlled devices is widespread, and includes such diverse mechanisms as electronic games, coin-operated laundries, pay telephones, toll stations, food vending machines and the like. Since such devices are typically left unattended, they are particularly susceptible to vandalism and abuse. Operators of such machines lose large sums of revenue due to fraudulent use of bogus coins, tokens and the technique of "stringing", which entails the use of a string attached to a coin of proper value which is inserted into the apparatus by the user and then withdrawn after all of the tests are passed, thereby obtaining a free vend.

Various efforts have been made in the prior art to defeat such fraudulent use of the vending machines, including means for detecting and measuring selected parameters of a coin supplied to the apparatus. Examples of some such devices are disclosed in the aforementioned U.S. Pat. Nos. 3,978,962 and 4,089,400 and the patents cited therein.

Most of these devices are relatively complex and expensive, and are, themselves, subject to abuse. For instance, the majority of coin testing devices presently in use rely upon mechanical testing means for testing the physical size and metal content of the coins. Experience has shown that these devices can be defeated or rendered inoperable by introducing foreign material into the mechanism or by applying a sharp blow to it. Many of the devices can be "fooled" by dropping a coin of proper value into the machine, but then withdrawing the coin by means of a string attached to it after all of the tests have been passed.

PURPOSE OF THE INVENTION

The primary object of this invention is to provide a coin testing apparatus which is simple and economical in construction and reliable in use.

Another object of the invention is to provide a coin testing apparatus which uses electronic coin testing means and possesses a minimum amount of moving mechanical parts, thus rendering the apparatus less susceptible to physical abuse.

A further object of the invention is to provide a coin testing apparatus which includes electronic means to sense and defeat attempts at "stringing" or withdrawing coins back through the apparatus after they have been supplied thereto.

A still further object of the invention is to provide a coin testing apparatus which includes optical sensing means for detecting certain physical parameters of a coin and for producing a "vend" or "reject" signal in response to the sensed parameters, and wherein the optical sensing means is constructed such that it is extremely sensitive to the parameter being measured, and at the same time permits the use of a high intensity signal for the optical device, thereby rendering the apparatus less susceptible to external environmental factors.

Yet another object of the invention is to provide a coin testing apparatus in which means is provided to prevent withdrawal of a coin from the apparatus by use of string attached to the coin.

SUMMARY OF THE INVENTION

These and other objects and advantages of the invention are accomplished by the coin testing apparatus described herein. A ramp is disposed to receive coins supplied to the apparatus and coins are constrained to roll down the ramp. A first optical means is positioned in predetermined spaced relationship with the ramp to detect the diameter and thickness of a coin rolling therepast. The first optical means includes light emitting means and light sensitive means on opposite sides of the path of the coin, with the light sensitive means mounted in an opening which is positioned such that a coin of proper thickness and diameter will completely cover and block the opening to light passing thereinto from the light emitting means. The light emitting means is disposed in an opening positioned angularly relative to the light sensitive means, so that light can only pass from the light emitting means to the light sensitive means when a coin is of insufficient thickness and diameter to completely block the opening to the light sensitive means. This arrangement enables high intensity lights to be used, thus rendering the apparatus less susceptible to external environmental conditions. When a coin of proper diameter and thickness is detected, a first signal of predetermined timed duration is produced by a first timer circuit.

A second optical means is positioned adjacent the first optical means to sense the reflectivity from the side of the coin and is operable to produce a second signal when the proper reflectivity is detected.

The first signal is supplied to a plurality of latches to reset or enable them, and the second signal is supplied to the latches to set them and provide an output signal which turns on an electromagnet and a solenoid.

Coins having magnetic material therein are detained by the electromagnet until the timed duration expires, at which time the magnetic coins are rejected.

The solenoid operates a movable ramp segment, urging it from an at-rest position for rejecting coins to an energized position for conveying an acceptable coin past a "vend" device to a collection box.

The output signal from one of the latches is supplied to a NAND gate which, in turn, provides a reset signal to a second timer circuit. The second timer circuit is also connected with a third optical means disposed in the path of a coin leaving the ramp. So long as the proper reset signal is supplied to the second timer circuit, the apparatus remains operative and blockage of the third optical means by a coin moving therepast has no effect. However, if a coin is dropped into the apparatus and an effort is made to draw it back up through the apparatus, blockage of the third optical means will be out of sequence and the second timer circuit will disable or reset the first timer circuit for a predetermined period of time during which a "vend" cannot be obtained.

The output or reset signal from the NAND gate is supplied, via a second NAND gate, to another latch to reset the latch.

A fourth optical means is positioned to sense a coin progressing through the apparatus from the reject gate or movable ramp segment, and only acceptable coins are detected by the fourth optical means. This fourth optical means is connected to provide a set signal to the last mentioned latch, providing an output to turn on a "vend" mechanism.

The time duration set by the first timer circuit is very short, being on the order of about five milliseconds. Thus, all of the tests have to be successfully completed within this time in order to obtain a "vend".

The third optical means and second timer circuit effectively prevent "stringing" or withdrawal of coins from the apparatus in an effort to fraudulently obtain a "vend", and a detent or groove is associated with the ramp to receive the string attached to a coin and trap the coin, preventing its withdrawal.

BRIEF DESCRIPTION OF THE DRAWINGS

Other objects of this invention will appear in the following description and appended claims, reference being made to the accompanying drawings forming a part of the specification, and wherein like reference characters designate corresponding parts in the several views.

DESCRIPTION OF THE PREFERRED EMBODIMENTS

Figure 1:
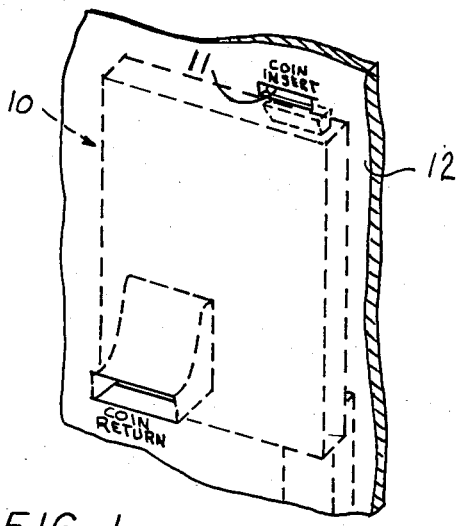
FIG. 1 is a somewhat schematic perspective view of a portion of the panel of a machine with which the coin testing device is associated, showing the coin testing device in dashed lines.

More specifically referring to the drawings, the coin testing apparatus, indicated generally at 10, receives and tests a coin C inserted through slot 11 in the front panel 12 of the machine with which the testing apparatus is associated.

Figure 4:
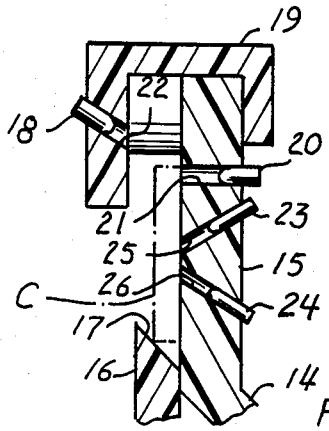
FIG. 4 is a greatly enlarged, fragmentary sectional view taken along line 4—4 in FIG. 2.

The coin testing apparatus 10 comprises a body or plate 13 having a rectangularly shaped lower portion 14 and a smaller rectangularly shaped upper portion 15. The upper portion or plate is angularly inclined to the vertical at an angle of about 45° so that a coin fed into the apparatus remains in contiguous, sliding contact with the plate 15. A track or rail 16 is supported at the bottom edge of upper plate 15, and as seen best in FIG. 4, has an inclined upper surface 17. A coin fed through slot 11 drops onto the rail and rolls along the inclined upper surface 17 while resting in sliding contact with the upper plate 15.

The rail 16 is inclined to the horizontal whereby the coin rolls downwardly with a suitable speed, and the inclined upper surface 17 of the rail supports a coin in predetermined elevated position, depending upon the thickness of the coin.

A first optical device is mounted on the upper plate 15 and comprises an LED 18 supported in a mounting bracket 19 secured to the top of the upper plate 15, and a phototransistor 20 supported on the upper plate 15. As seen best in FIG. 4, the phototransistor 20 is supported in an opening 21 aimed across the path of a coin rolling down the track. The LED is supported in an inclined opening 22 aimed downwardly toward the opening 21. Thus, a coin C of the proper diameter and thickness will just block the opening 21, preventing light from the LED from striking the phototransistor 20. Due to the angular relationship of the openings 21 and 22, the coin must completely cover the opening 21 or else light from the LED will impinge on the phototransistor. This enables relatively bright light to be used, reducing the possibility of erroneous readings caused by environmental conditions. Also, the sensitivity of the apparatus is significantly increased.

Coins of excessive diameter and thickness will generally be excluded by the feed slot in the front panel of the machine.

A second optical device immediately follows the first optical device, and comprises an LED 23 and phototransistor 24 mounted in openings 25 and 26, respectively, in the top plate 15 and aimed angularly toward one another. Thus, when a coin rolls down the track, light from the LED will be reflected off the side of the coin onto the phototransistor if the coin has the proper reflectivity.

An electromagnet 27 is disposed to one side of the path of the coin rolling down the track 16 and is spaced adjacent the end of the track 16 to detain a coin having magnetic properties and prevent its further advancement through the apparatus. The electromagnet is energized in response to sensing of an acceptable coin by the first and second optical devices.

Figure 2:
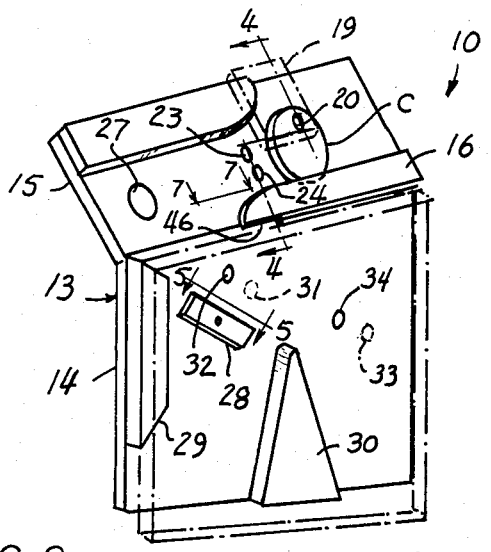
FIG. 2 is a front perspective view of the coin testing device of the invention, showing the front panel thereof in dot-and-dash lines for sake of clarity.
Figure 3:
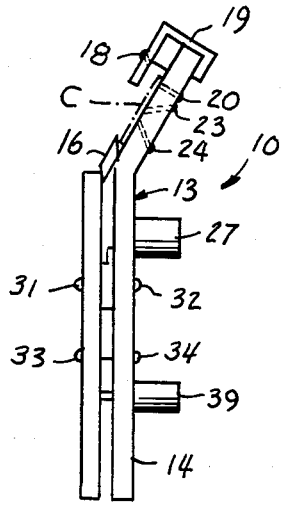
FIG. 3 is an end view in elevation of the coin testing device of the invention.
Figure 5:
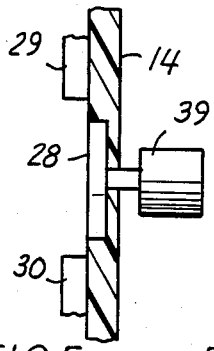
FIG. 5 is a greatly enlarged, fragmentary sectional view taken along line 5—5 in FIG. 2, showing the reject gate in a deenergized, at-rest, reject position.
Figure 6:
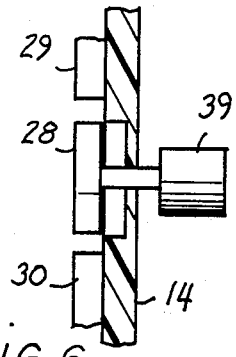
FIG. 6 is a view similar to FIG. 5, showing the reject gate in an energized, accept position.

A movable gate or rail 28 is mounted beneath the end of track 16 and magnet 27 and is positioned across the opening into a reject slot or channel defined between a pair of deflectors 29 and 30 on the bottom plate 14. The gate is moved into position blocking entrance into the reject channel and bridging the space between the deflectors when the first and second optical devices sense an acceptable coin (see FIGS. 2 and 6). If the coin is unacceptable, the gate remains in its retracted position as shown in FIG. 5, and the coin falls into the reject channel.

A third optical device comprising an LED 31 and phototransistor 32 is positioned above the gate 28 in the path of a coin rolling along the movable gate. If the coin is acceptable and all of the preceding tests have been successfully passed, interruption of this light by the coin has no effect on the operation of the apparatus. However, if an effort is made to withdraw the coin back out of the apparatus and the coin interrupts this light, a signal is produced which disables the vending machine for a predetermined time.

A fourth optical device comprising a LED 33 and phototransistor 34 is positioned in the path of a coin which has traversed the gate. Interruption of this light results in a vend signal.

Figure 8:
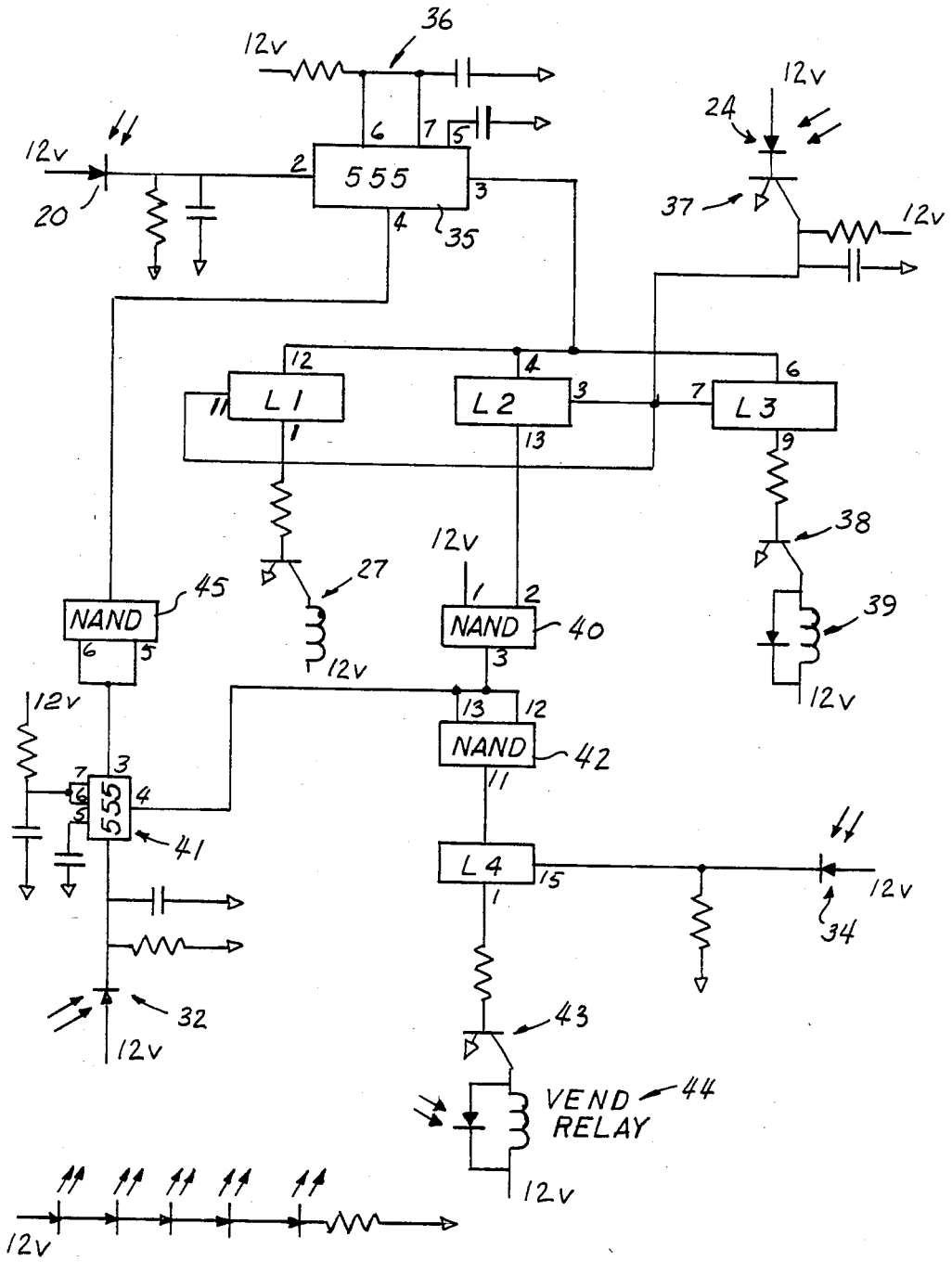
FIG. 8 is a schematic diagram of a circuit used in the device of the invention.

The circuitry associated with the lights, phototransistors, gate and electromagnet is illustrated in FIG. 8. A coin interrupting light to phototransistor 20 causes the phototransistor to go low, and this low signal is applied to pin 2 of 555 timer 35, turning the timer on for a period of time determined by the R-C circuit or timing network 36. For example, the duration of time the 555 timer is on could be on the order of five milliseconds.

The output of 555 timer 35 goes high and is applied to the reset pins of latches $L_1$, $L_2$ and $L_3$ in a 4044 IC, enabling them to be set by the proper signal.

When the coin passes LED 23 and phototransistor 24, if the coin has the proper reflectivity the phototransistor 24 receives reflected light from LED 23 and provides a high signal to transistor 37, which inverts the signal and supplies a low signal to the latches $L_1$, $L_2$ and $L_3$, setting them.

Setting of the latches causes their outputs to go high, turning on electromagnet 27 and detaining all coins having magnetic content until the timed duration of the signal from 555 timer 35 expires. The output from latch $L_3$ is applied to transistor 38, which inverts the signal and turns on or energizes a solenoid 39, extending the gate 28 and bridging the space between deflectors 29 and 30 to support the coin after it leaves the track 16. Thus, magnetic coins will be held by the electromagnet until the solenoid is deenergized upon expiration of the time set by timer 35, and the gate is retracted, permitting bogus or unacceptable coins to fall into the reject channel. Coins which are non-magnetic will not be detained by the electromagnet and will continue to roll across the gate 28.

The high output from latch $L_2$ is applied to one input of one quarter 40 of a QUAD NAND 4011 IC, causing its output to go low. This low output is applied to the reset pin of a second 555 timer 41 and to a second quarter 42 of the 4011 IC, causing its output to go high.

The high output from the second quarter 42 of 4011 IC is applied to latch $L_4$, resetting the latch. Thus, when an acceptable coin moves past LED 33 and phototransistor 34, blocking light from LED 33 to phototransistor 34, the output from the phototransistor 34 goes low, setting the latch $L_4$ and providing an output to a transistor 43 which turns on or energizes vend relay 44.

In moving across the gate 28 the coin also passes between LED 31 and phototransistor 32, causing the output of phototransistor 32 to go low. This low signal is applied to the set pin of 555 timer 41, but since the reset pin is low (signal from NAND gate 40), there is no output from the 555 timer 41 and the output from the third quarter 45 of the 4011 IC stays high. Therefore, the 555 timer 35 continues to provide its output signal for the timed duration originally set.

Figure 7:
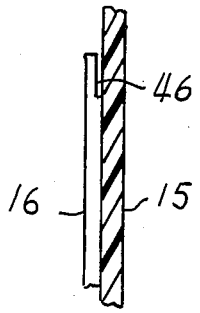
FIG. 7 is a greatly enlarged, fragmentary sectional view taken along line 7—7 in FIG. 6.

However, if latch $L_2$ has not been set (resulting, for instance, from a coin of improper reflectivity), and the phototransistor 32 is blocked, the timer 41 is turned on and the output from timer 41 is applied through NAND gate 45 to reset pin of timer 35, resetting it for a predetermined time during which a vend cannot be obtained. Another instance which would cause timer 41 to reset timer 35 is when a coin is caused to move back past phototransistor 32, as for example, by means of a string attached to the coin. Because of the timing of the timer 35, this could only occur after the timing sequence of timer 35 had expired. Thus, the low signal from phototransistor 32 would set timer 41 and cause timer 35 to be reset, since there would not be any low signal applied to the reset pin of timer 41. A notch 46 is formed at the lower end of rail 16 (see FIGS. 2 and 7) to trap the string (not shown) whenever someone attempts to obtain a fraudulent vend by the technique of "stringing".

While the coin testing apparatus has been shown and described in detail, this invention is not to be considered as being limited to the exact form disclosed, and changes in detail and construction may be made therein within the scope of the invention, without departing from the spirit thereof.

Having thus set forth and disclosed the nature of this invention, what is claimed is:

1. A coin testing apparatus for discriminating between acceptable and unacceptable coins and the like, and for providing a vend signal in response to sensing of an acceptable coin, comprising:

an inclined track down which coins fed to the apparatus are constrained to roll from an inlet and thereof to an outlet end;

a plurality of light emitting means and light sensitive means arranged in predetermined spaced relationship to the track to sense a plurality of parameters of the coin as the coin rolls along the track;

first timer means connected with the light sensitive means to be turned on for a predetermined time duration in response to the sensing of a first parameter of the coin, said time duration being calculated to approximate the time it would take a valid coin to roll unimpeded down the inclined track and past all of the light emitting means and the light sensitive means;

magnet means positioned adjacent the track in a location to attract and detain until expiration of the time duration any coin having magnetic material therein;

reject means adjacent the outlet end of the track and operative in response to sensing of an improper parameter to reject coins having the improper parameter;

said light emitting means and associated light sensitive means including a light and phototransistor located adjacent the outlet end of the track in a location such that the light to the light sensitive means is blocked upon passage of a coin therebetween, producing a signal;

second timer means connected to receive said signal, said second timer means being unaffected by passage of an acceptable coin between said light and phototransistor, but being turned on for a predetermined time upon passage of an unacceptable coin or upon withdrawal of a coin therepast; and said second timer means being connected to reset the first timer means and inhibit a vend for said predetermined time when it is turned on.

2. A coin testing apparatus as claimed in claim 1, wherein:

the track includes a notch positioned to entrap a string attached to a coin supplied to the apparatus, to prevent withdrawal of the coin.

3. A coin testing apparatus as claimed in claim 2, wherein:

a first light emitting means and associated light sensitive means are located in predetermined spaced relation to the track on opposite sides of the path of a coin rolling down the track such that a coin of acceptable diameter and thickness blocks the light to the light sensitive means, producing a first signal, said first signal being applied to the first timer means to turn it on, producing an output signal of predetermined time duration;

a second light emitting means and associated light sensitive means are located on one side of the track and are aimed to sense the reflectivity from the side of the coin, producing a second signal;

circuit means responsive to the output from the first timer means and to the second signal and operative to reset a latch means; and a third light emitting means and associated light sensitive means located to sense the presence of a coin which has passed all of the tests and to produce a third signal in response thereto, said third signal being applied to set the latch and obtain an output operative to turn on a vend device.

* * * * *